US010608396B1

(12) United States Patent
Ahlers

(10) Patent No.: US 10,608,396 B1
(45) Date of Patent: Mar. 31, 2020

(54) METHOD OF RELEASABLY SECURING A PLURALITY OF ITEMS IN A RETAIL STORE INVENTORY

(71) Applicant: Paige Electric Company, LP, Union, NJ (US)

(72) Inventor: Mark D. Ahlers, Columbus, NE (US)

(73) Assignee: Paige Electric Company, LP, Union, NJ (US)

( * ) Notice: Subject to any disclaimer, the term of this patent is extended or adjusted under 35 U.S.C. 154(b) by 120 days.

(21) Appl. No.: 14/923,096

(22) Filed: Oct. 26, 2015

Related U.S. Application Data

(62) Division of application No. 14/171,417, filed on Feb. 3, 2014, now Pat. No. 9,203,185.

(60) Provisional application No. 61/760,957, filed on Feb. 5, 2013.

(51) Int. Cl.
*H01R 43/20* (2006.01)
*H01R 43/26* (2006.01)

(52) U.S. Cl.
CPC ..... *H01R 43/26* (2013.01)

(58) Field of Classification Search
CPC . H01R 4/24; H01R 4/26; H01R 11/18; H01R 13/58; H01R 43/26
See application file for complete search history.

(56) References Cited

U.S. PATENT DOCUMENTS 5,294,909 A * 3/1994 Frazier ..... G01M 3/045 338/214
7,932,480 B2 * 4/2011 Gu ..... H05B 1/0244 219/482
8,143,987 B2 * 3/2012 Kireev ..... H01L 23/5227 336/200
8,399,769 B2 * 3/2013 Doll ..... H04R 1/1033 174/110 R
2016/0371945 A1 * 12/2016 Ewen, III ..... G08B 13/1418

* cited by examiner

*Primary Examiner* — Paul D Kim
(74) *Attorney, Agent, or Firm* — Cook Alex Ltd.

(57) ABSTRACT

A method of protecting retail store inventory from theft includes the steps of providing an electrical alarm circuit which is electrically connectable to a security loop cable. The security loop cable includes a plurality of electrically conductive and connectable security loop cable segments. A user forms the security loop cable by connecting the plurality of security loop cable segments end-to-end and attaches the security loop cable to the items of inventory. The free ends of the security loop cable are physically secured, including at least one of the free ends being physically secured by electrically connecting it to the electrical alarm circuit. The physical securement of the free ends prevents detachment of the inventory items from the cable. The alarm system when armed will activate an alarm if electrical continuity of the security loop cable is broken.

20 Claims, 5 Drawing Sheets

METHOD OF RELEASABLY SECURING A PLURALITY OF ITEMS IN A RETAIL STORE INVENTORY

CROSS REFERENCE TO RELATED APPLICATIONS

This application claims the benefit of U.S. Provisional Patent Application Ser. No. 61/760,957, filed Feb. 5, 2013. This application is a divisional of U.S. patent application Ser. No. 14/171,417, filed Feb. 3, 2014, now U.S. Pat. No. 9,203,185.

FIELD OF THE DISCLOSURE

The present disclosure is directed to electrical cable suitable for securing physical inventory.

BACKGROUND

Retail stores selling relatively large yet movable items such as outdoor furniture, lawn mowers and tractors, snow blowers, grills, bicycles and the like often find it desirable to display such items outside the confines of their building. Typically the inventory is displayed at or near the entrance to the store to attract the attention of shoppers as they enter or leave the store. The storefront often offers the only suitable space large enough to display more than one or two bulky items such as outdoor furniture or power equipment.

Securing such openly displayed inventory from theft and damage is a problem. This is especially true at the close of business. In the past store owners seeking to secure outdoor inventory have had to choose among several undesirable options. One option is to physically move the inventory back into the confines of the store's building. This takes considerable time at a point in the workday when employees are anxious to leave the premises, leading to the risk of damage to the inventory. It also requires considerable inside storage space, the absence of which is commonly what lead to the outdoor display in the first place. Thus, moving the inventory inside usually means placing it in a temporary location where it will interfere with some other normal operation of the store.

An alternative to moving the inventory back into the store is to leave it out but physically secure it to prevent removal. This typically meant use of long metal chains or stranded steel cable attached somehow to the items and with both terminal ends of the chain or cable anchored and locked to the property. The inventory items sometimes do not have a convenient attachment point for the chain or cable, which requires the chain to be looped through or around a handle or a similar component not designed for the purpose, sometimes with resultant damage to the finish of the item. A further alternative to the chain or steel cable is a long, single length of electrical cable secured to the items and connected to an alarm system. While an insulated electrical cable is less likely to damage the inventory than a chain or steel cable, it shares with the chain and steel cable another drawback.

The basic problem with prior, single-length physical or electrical securement devices was that, during business hours, should a customer want to purchase one of the products that was anywhere remote from the ends of the cable, the seller has to disconnect the entire inventory between the two end pieces and the item being sold, just to release the item being delivered to the customer. This requires significant time and labor. Plus every time you disconnect and reconnect the securement devices you add to the chances of damaging the unsold inventory.

SUMMARY

In one aspect, the present disclosure concerns an insulated, multi-conductor electrical security cable manufactured in short, manageable lengths or segments. Each segment has on one end a specifically designed and over-molded male connector and on its other end a similar, mating female connector. During store hours, when a sale has been made and an item needs to be removed from the security cable, the alarm system can be temporarily turned off and the connectors of mating lengths of the cable can be disconnected in close proximity to the sold product to allow its intentional removal from the security cable. This multi-segmented, insulated security cable eliminates a majority of the time, labor and damage associated with complete removal and reinstallation of a single-length security cable.

Making the electrical security cable of the present invention in multiple segments allows the cable to be assembled to any length desired. It also allows separation of segments at multiple locations if desired. The multi-segmented security cable with specially designed male and female connectors on the ends of each segment allows electrical continuity throughout the length of the connected cable. Each male and female connector is attached electrically and physically through means of mechanical connection and over-molding. A compression ring, also sometimes called a hog ring, is tightened around the connector body which is over-molded to produce a high friction connection by physically indenting the outer surface of the connector body material. The exposed hog ring area when over-molded provides an interference fit strength member.

Further, the exposed outer diameter of the compression ring forms half of an O-ring fitting. The cable and compression O-ring are then over-molded with plastic during the molding process to form the male/female plug ends. The combination of the over-molding and compression ring creates a connection that requires a very high tensile force to pull off the conductor cable. Each finished cable is capable of withstanding a maximum pull apart force of 80 pounds. Also, each connected male and female combination is able to withstand an immersion of one meter in water without electrically shorting. That is, during the over-molding process the outside diameter of the male fitting and the inside diameter of the female fitting are set so that when completed and the fittings are joined, the fitting is impervious to water to a depth of one meter.

DETAILED DESCRIPTION OF THE EMBODIMENTS

Figure 1:
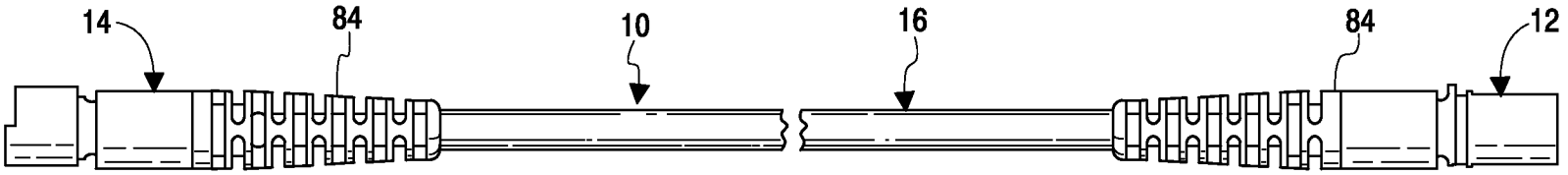
FIG. 1 is a side elevation view of a single segment of the security cable of the present disclosure, showing a female connector on the left end and a male connector on the right end.

FIG. 1 illustrates a single segment 10 of a multi-segmented security loop cable wherein each segment 10 has a male connector 12 on one end and a female connector 14 on the other end. The connectors are joined by an electrical cable 16. As will be explained below, the cable may have an outer jacket which contains one or more wires therein. Usually between one and four wires are provided. A plurality of connected segments 10 may be used to make a complete security loop cable of sufficient length for a particular application. The length of the cable 16 of a particular segment is chosen to suit a particular need. When the items to be protected are larger or anticipated to be displayed with greater separation between them, longer cables may be used.

It will be understood that a complete security loop cable will include a plurality of segments 10. The exact number can vary depending on the total length needed. It will also be understood that at least one of the free ends of the multi-segmented security loop cable is electrically connected to an alarm system (not shown). It may be that both ends are connected to the alarm system or just one end is connected to the alarm system with a suitable terminator being plugged into the opposite end. The alarm system is such than an unintended separation of any of the segments of the multi-segmented security loop cable will create an alarm condition, which may generate an audible or visual signal in the vicinity of the inventory being protected. Or there could be a combination of the audible and visual signal. Alternatively the alarm condition may generate a silent alarm to security personnel or the focusing of cameras on a particular location.

Each connector 12, 14 includes one or more contacts and an elastomeric rubber body. The contacts are fixed to the bare ends of wires and embedded in the body. Together the contacts and body form a housing. The exterior of the housing has a tightly fitting compression ring surrounding the body to prevent the contacts from being withdrawn from the body. The end of the cable and the rear portion of the housing are covered by an over-molded strain relief member 84 to complete the connector structure The strain relief member chemically bonds to the connector (male or female) body, exposed wire insulations and the cable outer jacket to form an integral unit of these elements for electrical and mechanical protection. Details of these components will now be described.

Figure 2:
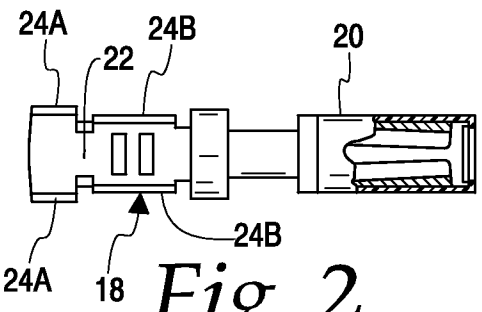
FIG. 2 is a top plan view of a socket contact prior to installation of a wire and with a portion of the sleeve cut away.
Figure 3:
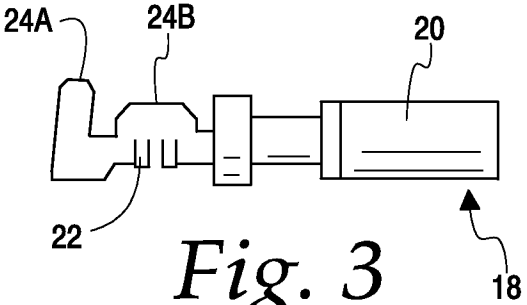
FIG. 3 is a side elevation view of the socket contact of FIG. 2 but with no portion cut away.

FIGS. 2 and 3 illustrate one type of contact. This is a socket contact 18. The socket contact has a generally hollow sleeve 20 at one end joined to a crimp pot 22 at the opposite end. The interior of the sleeve 20 is sized to receive a contact pin that will be described below. The sleeve may be made of stainless steel. The crimp pot 22 has fingers 24A and 24B which are folded down or crimped about an end of a wire inserted therein. The crimp pot may be made of a spring copper alloy.

Figure 4:
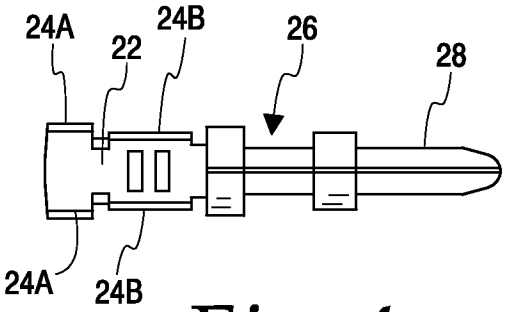
FIG. 4 is a top plan view of a pin contact prior to installation of a conductor.
Figure 5:
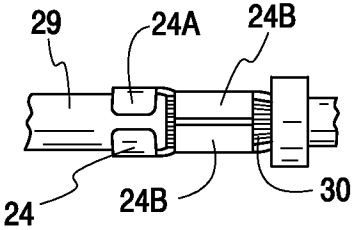
FIG. 5 is a plan view of a crimp pot of a socket contact or pin contact after crimping about a conductor.

FIG. 4 illustrates a second type of contact. This is a pin contact.26. It has a prong 28 at one end joined to a crimp pot 22 at the other end with fingers 24A, 24B. The prong 28 is sized to fit snugly inside the sleeve 20 such that when joined the prong and sleeve are in firm but releasable electrical engagement with one another. FIG. 5 illustrates how the fingers 24A, 24B of a crimp pot 22 can be crimped down about the insulation 29 and a bare conductor 30 of a wire from cable 16. The insulation 29 of the wire is stripped from the end to expose the conductor 30 which is then placed in the crimp pot 22. A crimping tool is preferably used to fold the fingers 24A tightly onto the insulation 29 while the fingers 24B engage the conductor 30. The fingers 24B make firm, non-releasable electrical contact between the conductor 30 and the crimp pot.

Figure 7:
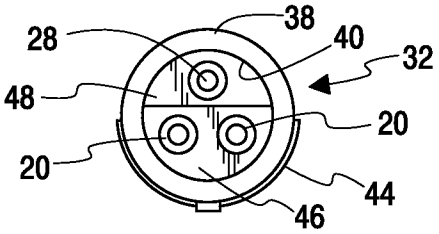
FIG. 7 is an end elevation view of a plug housing, looking from the left side of FIG. 6.
Figure 6:
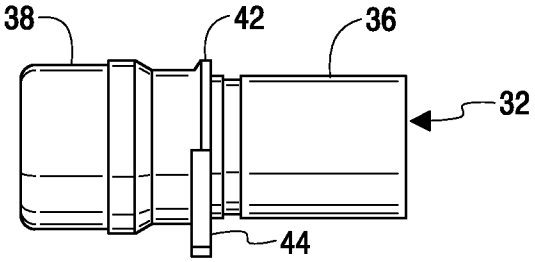
FIG. 6 is a side elevation view of a plug housing prior to over-molding.
Figure 8:
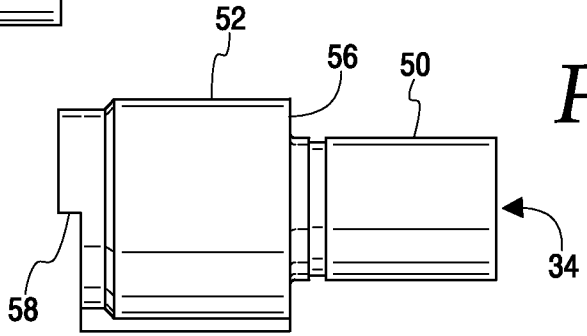
FIG. 8 is a side elevation view of a receptacle housing prior to over-molding.
Figure 9:
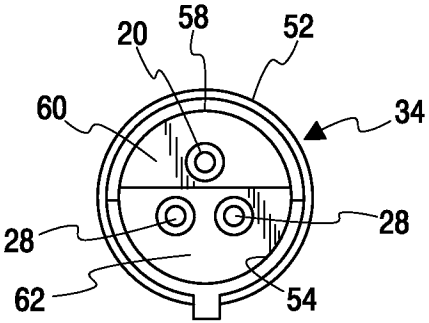
FIG. 9 is an end elevation view of a receptacle housing, looking from the left side of FIG. 8.

After the contacts have been crimped onto a wire, they are installed in an elastomeric rubber body. There are two types of bodies. A male body 32 is shown in FIGS. 6 and 7 while a female body 34 is shown in FIGS. 8 and 9. Each body is a generally cylindrical, solid mass of rubber except for hollow portions at the front ends and longitudinal apertures for receiving the contacts. The male body 32 has a rear or base portion 36 and a forward or shroud portion 38 which defines a hollow interior 40. The base 36 extends about two-thirds of the overall length of the body while the shroud 38 is about one-third of the length. An external, semi-circular flange 42 surrounds the top half of the base portion at roughly the center of the overall body length. Flange 42 is bounded by an external, semi-circular collar 44 which extends around the lower half (as seen in FIGS. 6 and 7) of the male body. The longitudinal extent of the hollow interior 40 is varied by an internal, semi-circular key 46 (FIG. 7). The key 46 is an extension of the rubber mass. It approaches the open end of the shroud 38. In other words, the hollow interior is deeper at an internal transverse wall 48 than it is at key 46. As seen in FIG. 7, this embodiment has a single prong 28 of a pin contact extending through transverse wall 48 and into the hollow interior. It also has two sleeves 20 of socket contacts embedded in the key 46.

The female body 34 has a structure generally similar to that of the male body 32 except the shroud of the female body has an inside diameter large enough to receive the outside diameter of the male body's shroud. Also, the key of the female body is rotated 180° from the orientation of the key in the male body. That is, the female key is in the upper half of the shroud instead of the lower half. Looking at the female body 34 in FIGS. 8 and 9, it has a rear or base portion 50 and a forward or shroud portion 52 which defines a hollow interior 54. The base 50 extends about two-thirds of the overall length of the body while the shroud 52 is about one-third of the length. An external circular flange 56 surrounds the base portion at roughly the center of the overall body length. An external, semi-circular collar 58 extends around the upper half (as seen in FIGS. 8 and 9) of the shroud 52 and the front end. The longitudinal extent of the hollow interior 54 is varied by an internal, semi-circular key 60 (FIG. 9). The key 60 is an extension of the rubber mass that approaches closer to the open end of the shroud 52 than does an internal transverse wall 62. In other words, the hollow interior 54 is deeper at the internal transverse wall 62 than it is at key 60. As seen in FIG. 9, this embodiment has two prongs 28 of a pin contact extending through transverse wall 62 and into the hollow interior 54. It also has a single sleeve 20 of a socket contact embedded in the key 60.

Figure 10:
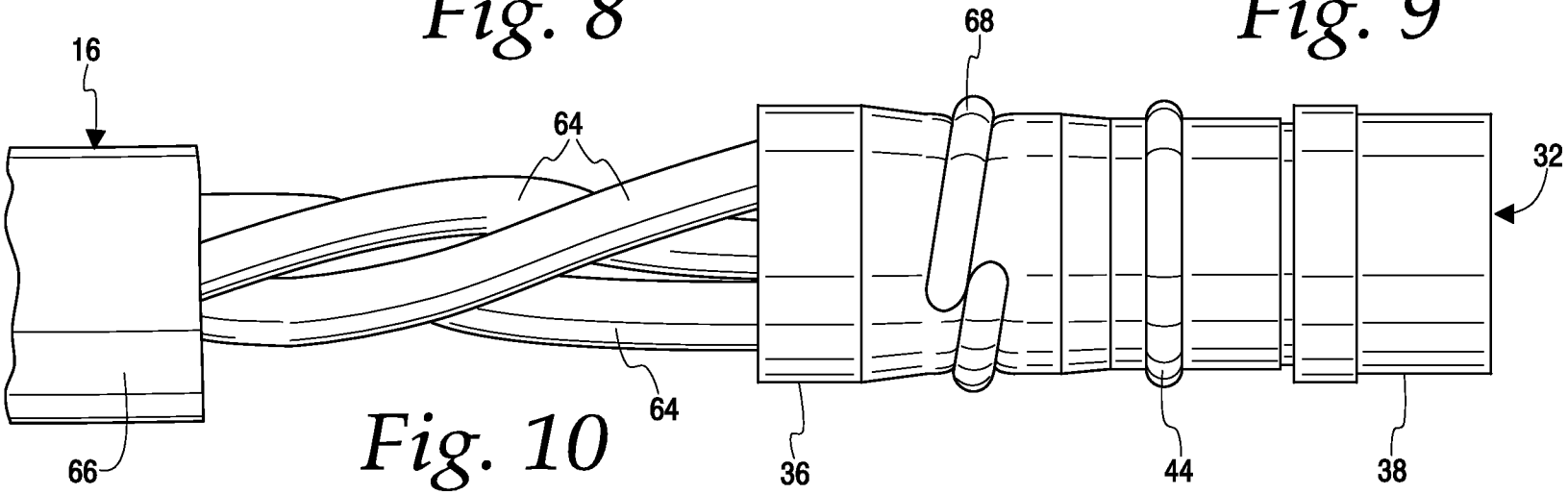
FIG. 10 is a plan view, on an enlarged scale, of a plug housing with three wires installed therein and a compression ring attached thereto, prior to over-molding.

In both the male and female bodies the socket and pin contacts, with conductors already crimped thereto, are pressed into the longitudinal body apertures through the back side of the rear or base portions 36 or 50. Preferably the strip length of the conductors and the amount of insertion of the contacts is such that the insulation on the conductors extends a little bit into the base portions, with the remainder of the conductors extending out the back of the base portions. This is illustrated in FIG. 10. Three conductors 64 protrude from the base portion 36. The outer jacket 66 of the cable 16 is cut away sufficiently to allow manipulation of the individual conductors 64 for stripping, crimping and insertion into the base portion of the body.

While the friction fit of the contacts in the base portions is significant, the present disclosure adds an extra measure of pullout strength by adding a compression ring 68 after insertion of the contacts. As seen in FIG. 10, the compression ring is tightened around the base portion of the body to indent the surface of the base portion, thereby locking the sockets in the body. The outer diameter of the compression ring 68 provides an interference fit strength member with the over-molded strain relief member to be described below. The compression ring also forms half of an O-ring fitting during the over-molding process.

Figure 11:
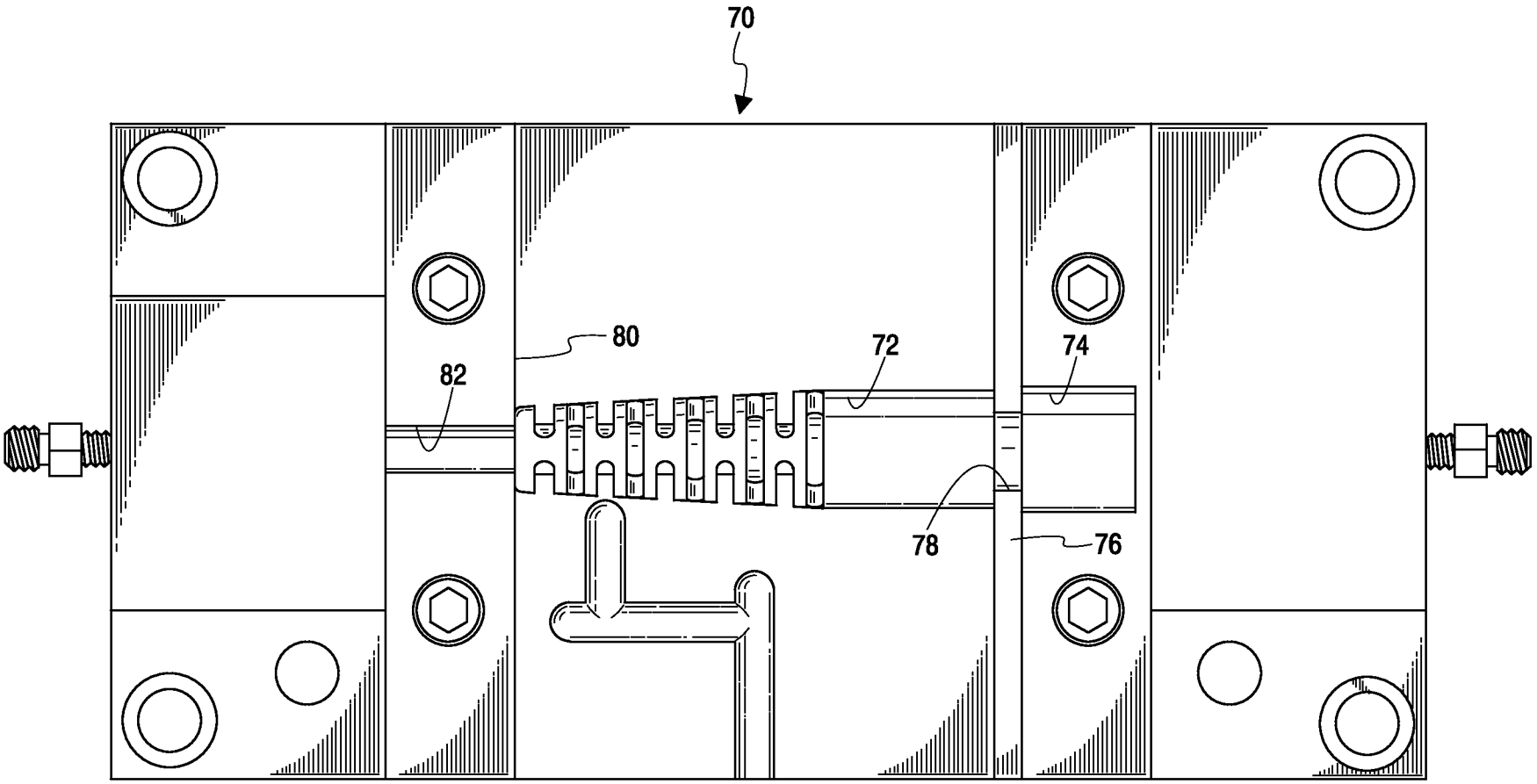
FIG. 11 is a plan view of the bottom half of a thermoplastic injection mold.

The combination of a body and its embedded contacts together form a housing. As just described the exterior of the housing has a tightly fitting compression ring 68 surrounding the body to prevent the contacts from being withdrawn from the body. The housing and compression ring of FIG. 10 are ready for addition of an over-molded strain relief member to complete the connector structure. The over-molding process can be performed in a mold, half of which is shown in FIG. 11 at 70. The mold includes a strain relief cavity 72 and a shroud cavity 74. These are separated by a partition 76 which has a semi-circular receptacle 78. The rear of the strain relief cavity 72 is bounded by a wall 80 which includes a cable passage 82. The usual cooling passages and material feed lines (not shown) are included in the complete mold.

Figure 13:
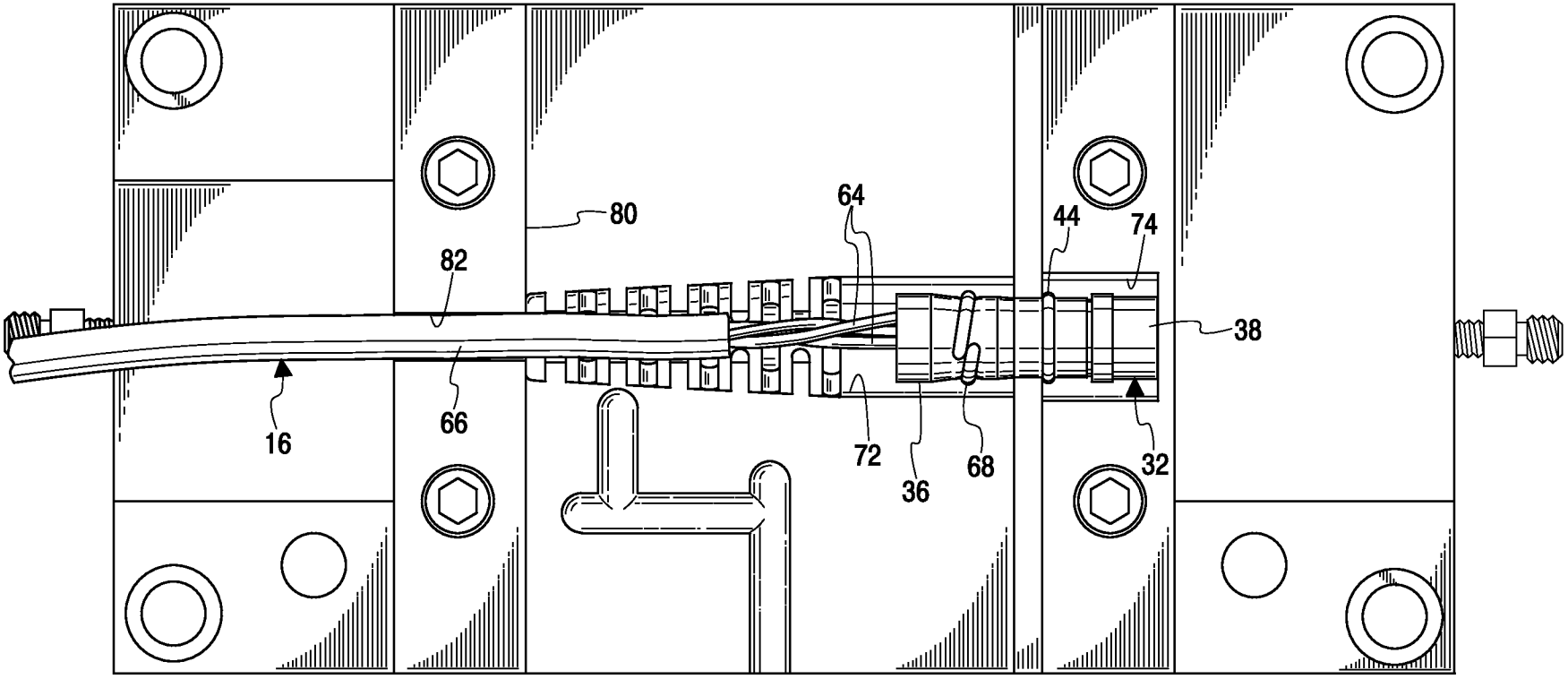
FIG. 13 is a plan view similar to FIG. 11 but with a three-wire cable attached to a plug housing and in place in the mold ready for closure of the top half of the mold (not shown) prior to over-molding.

As seen in FIG. 13, the male housing is placed in the mold with the flange 42 and collar 44 in the shroud cavity 74 and abutting against the partition 76. Most of the base portion 36 of the male body is in the strain relief cavity, although some of the base extends through the receptacle 78. The cable jacket 66 and conductors 64 are also in the strain relief cavity. A rearwardly extending portion of the cable jacket extends out through the cable passage 82. When the mold is filled, the strain relief cavity receives liquid elastomer, such as PVC. It solidifies to form the strain relief member 84 shown in FIG. 1. Note that the strain relief member extends from the outer jacket 66 well on to the base portion of the connector body, but not all the way on to the shroud.

Figure 12:
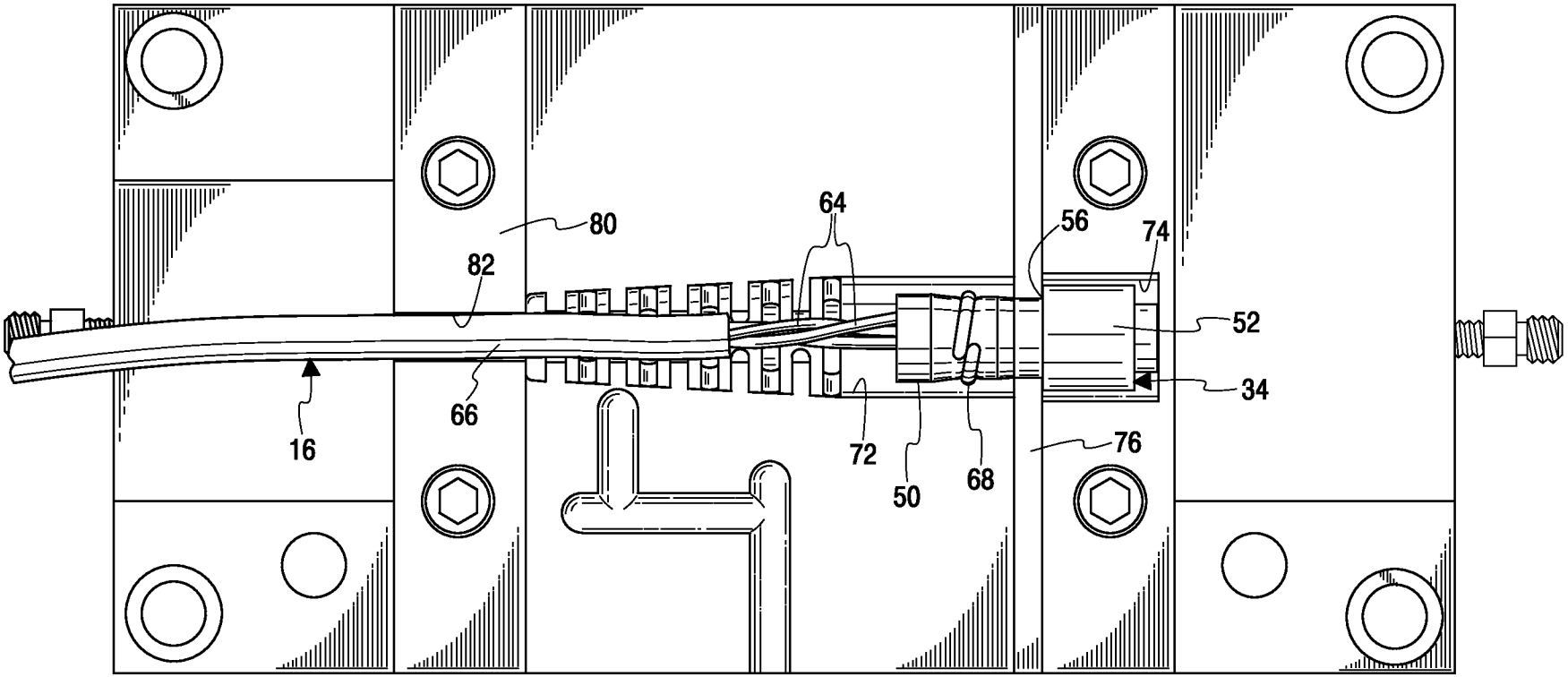
FIG. 12 is a plan view similar to FIG. 11 but with a three-wire cable attached to a receptacle housing and in place in the mold ready for closure of the top half of the mold (not shown) prior to over-molding.

FIG. 12 shows how the receptacle housing fits into the same mold 70. The flange 56 abuts the partition 76 to hold the assembly in place. Again the cable jacket 66 extends into the strain relief cavity 72 through the passage 82. The end of the jacket 66, the conductors 64 and a significant portion of the base portion of the connector body are over-molded by the strain relief member 84.

It will be apparent that the male connector of one cable segment can be releasably electrically connected to the female connector of an adjoining segment. Using the three-wire embodiment illustrated and the orientations shown in FIGS. 6-9, the male connector 12 is inserted into the female connector 14. The key 46 of the male body being in the bottom half will slide past the key 60 of the female body. Since the keys will only clear one another when they are properly oriented, they prevent mismatching of the prongs and sockets. As it is, the prongs of one housing fit into and electrically join the sleeves of the opposition housing. The collar 44 on the plug housing ends up mating with the collar 58 on the receptacle housing to indicate to the user when the connection is fully made. It can be seen that the plurality of cable segments as described above provides a complete cable that is usable indoors or out of doors due to the integral unit formed by the over-molded strain relief member for electrical and mechanical protection of the connectors (male or female). Since the over-molded strain relief member extends from the cable jacket 66, over the wires 64, and over at least a portion of the connector bodies (32 or 34), these elements become an integral unit on each end of the cable segment to increase the electrical and mechanical protection for the entire security loop cable. This integral unit renders the cable jacket 66, the wires 64 and the base portion of the connector bodies a hermetically sealed integral unit for protection from the environment. This enables use of the cable either indoors or outdoors.

It should be understood that various changes and modifications to the presently preferred embodiments described herein will be apparent to those skilled in the art. Such changes and modification can be made without departing from the spirit and scope of the invention disclosed herein. For example, different numbers of conductors could be used. An additional compression ring might be added. In the described method the order of the steps of connecting cable segments to one another and attaching items to the security loop cable could vary. That is, all of the cable segments may be connected together before attaching any item to the fully completed security loop cable. Alternately, it may be convenient to attach some of the items before all of the cable segments have been added to the complete security loop cable. Thus, some items may be attached during the process of attaching cable segments to the security loop cable. This interleaving of the steps of adding cable segments and attaching items might be convenient the first time a security loop cable is deployed and it is not certain ahead of time how many cable segments will be needed to provide sufficient length for all of the items.

The invention claimed is:

1. A method of protecting inventory from theft, the inventory including a plurality of items, comprising:

providing an electrical alarm circuit which is electrically connectable to a security loop cable and, when armed, will activate an alarm if electrical continuity of the security loop cable is broken;

providing a plurality of electrically conductive security loop cable segments, each security loop cable segment having a male connector on one end and a female connector on the other end, the male and female connectors of adjoining security loop cable segments being releasably mechanically and electrically connectable to one another;

forming a security loop cable by connecting the plurality of security loop cable segments end-to-end with a male connector of one security loop cable segment joined to a female connector of an adjoining security loop cable segment, the security loop cable having first and second free ends;

associating the security loop cable to the items without electrically connecting any of the security loop cable segments to any of the items, such that the items cannot be dissociated from the security loop cable without breaking the electrical continuity of the security loop cable; and physically securing the free ends of the security loop cable, wherein the first free end of the security loop cable is physically secured by electrically connecting the first free end to the electrical alarm circuit, the second free end of the security loop cable is physically secured by electrically connecting the second free end to a terminator or the electrical alarm circuit, and the physical securement of the free ends is such that the items cannot be dissociated from the security loop cable without breaking the electrical continuity of the security loop cable to the alarm circuit.

2. The method of claim 1 wherein a selected item of the inventory desired to be dissociated from the security loop cable can be removed by an authorized party from the remaining items of the inventory, such removal including disarming the alarm circuit, disconnecting the male and female connectors nearest said selected item, dissociating said selected item from the security loop cable at said disconnected connectors, removing said selected item, reconnecting the previously disconnected male and female connectors, and rearming the alarm circuit to reestablish protection for the remaining items.

3. The method of claim 1 wherein said providing a plurality of electrically conductive security loop cable segments includes providing the number of security loop cable segments needed to create a security loop cable of sufficient length to associate all of the plurality of items to the security loop cable.

4. The method of claim 1, wherein the alarm circuit is configured to generate an audible signal upon electrical continuity of the security loop cable to the alarm circuit being broken.

5. The method of claim 1, wherein the alarm circuit is configured to generate a visual signal upon electrical continuity of the security loop cable to the alarm circuit being broken.

6. The method of claim 1, wherein the alarm circuit is configured to generate audible and visual signals upon electrical continuity of the security loop cable to the alarm circuit being broken.

7. The method of claim 1, wherein the alarm circuit is configured to generate a silent alarm upon electrical continuity of the security loop cable to the alarm circuit being broken.

8. The method of claim 1, wherein the alarm circuit is configured to cause cameras to focus on a particular location upon electrical continuity of the security loop cable to the alarm circuit being broken.

9. The method of claim 1, wherein at least one of said plurality of items is associated to one of said plurality of security loop cable segments prior to complete formation of the security loop cable.

10. The method of claim 1, wherein each security loop cable segment is connected to the adjoining security loop cable segment(s) prior to associating said plurality of items to the security loop cable.

11. A method of protecting inventory from theft, the inventory including a plurality of items, comprising:

providing an electrical alarm circuit which is electrically connectable to a security loop cable and, when armed, will activate an alarm if electrical continuity of the security loop cable is broken;

providing a plurality of electrically conductive security loop cable segments, each security loop cable segment having a male connector on one end and a female connector on the other end, the male and female connectors of adjoining security loop cable segments being releasably mechanically and electrically connectable to one another;

forming a security loop cable by connecting the plurality of security loop cable segments end-to-end with a male connector of one security loop cable segment joined to a female connector of an adjoining security loop cable segment, the security loop cable having first and second free ends;

associating the security loop cable to each of the items by passing the security loop cable through an aperture defined at least in part by the item or wrapping the security loop cable around a portion of the item, such that the items cannot be dissociated from the security loop cable without breaking the electrical continuity of the security loop cable; and physically securing the free ends of the security loop cable, wherein the first free end of the security loop cable is physically secured by electrically connecting the first free end to the electrical alarm circuit, the second free end of the security loop cable is physically secured by electrically connecting the second free end to a terminator or the electrical alarm circuit, and the physical securement of the free ends is such that the items cannot be dissociated from the security loop cable without breaking the electrical continuity of the security loop cable to the alarm circuit.

12. The method of claim 11 wherein a selected item of the inventory desired to be dissociated from the security loop cable can be removed by an authorized party from the remaining items of the inventory, such removal including disarming the alarm circuit, disconnecting the male and female connectors nearest said selected item, dissociating said selected item from the security loop cable at said disconnected connectors, removing said selected item, reconnecting the previously disconnected male and female connectors, and rearming the alarm circuit to reestablish protection for the remaining items.

13. The method of claim 11 wherein said providing the plurality of electrically conductive security loop cable segments includes providing the number of security loop cable segments needed to create a security loop cable of sufficient length to associate all of the plurality of items to the security loop cable.

14. The method of claim 11, wherein the alarm circuit is configured to generate an audible signal upon electrical continuity of the security loop cable to the alarm circuit being broken.

15. The method of claim 11, wherein the alarm circuit is configured to generate a visual signal upon electrical continuity of the security loop cable to the alarm circuit being broken.

16. The method of claim 11, wherein the alarm circuit is configured to generate audible and visual signals upon electrical continuity of the security loop cable to the alarm circuit being broken.

17. The method of claim 11, wherein the alarm circuit is configured to generate a silent alarm upon electrical continuity of the security loop cable to the alarm circuit being broken.

18. The method of claim 11, wherein the alarm circuit is configured to cause cameras to focus on a particular location upon electrical continuity of the security loop cable to the alarm circuit being broken.

19. The method of claim 11, wherein at least one of said plurality of items is associated to one of said plurality of security loop cable segments prior to complete formation of the security loop cable.

20. The method of claim 11, wherein each security loop cable segment is connected to the adjoining security loop cable segment(s) prior to associating said plurality of items to the security loop cable.

* * * * *